US008064630B2

(12) United States Patent
Goldberg

(10) Patent No.: US 8,064,630 B2
(45) **Date of Patent: *Nov. 22, 2011**

(54) AUDIO SPEAKER UTILIZING AN UNANCHORED MAGNET FOR PRIMARY FORCE GENERATION

(75) Inventor: Joshua Gouled Goldberg, Santa Cruz, CA (US)

(73) Assignee: Sound Starts, Inc., Aromas, CA (US)

( * ) Notice: Subject to any disclaimer, the term of this patent is extended or adjusted under 35 U.S.C. 154(b) by 684 days.

This patent is subject to a terminal disclaimer.

(21) Appl. No.: 12/175,616

(22) Filed: Jul. 18, 2008

(65) Prior Publication Data

US 2009/0010481 A1 Jan. 8, 2009

Related U.S. Application Data

(63) Continuation of application No. 11/282,335, filed on Nov. 18, 2005, now Pat. No. 7,403,632.

(60) Provisional application No. 60/637,733, filed on Dec. 20, 2004.

(51) Int. Cl.
*H04R 1/00* (2006.01)
*H04R 9/06* (2006.01)

(52) U.S. Cl. ..... 381/415; 381/412

(58) Field of Classification Search ..... 381/396, 381/397, 407, 412, 413, 415; 181/146; 379/433.02; 84/723

See application file for complete search history.

(56) References Cited

U.S. PATENT DOCUMENTS 7,132,597 B2 * 11/2006 Hosler ..... 84/723

* cited by examiner

*Primary Examiner* — Brian Ensey
(74) *Attorney, Agent, or Firm* — Donald R. Boys; Central Coast Patent Agency, Inc.

(57) ABSTRACT

A speaker apparatus has a container holding a volume of ferrofluid, a permanent magnet suspended in the ferrofluid, and a magnetic excitation apparatus proximate the container. Operation of the excitation apparatus causes movement of the permanent magnet, translated through the ferrofluid to walls of the container, which walls act as resonators creating sound waves in surrounding medium. Audio production is accomplished placing a ferrofluid and a permanent magnet in a container, placing an excitation apparatus in proximity of the permanent magnet, and driving the excitation apparatus to cause movement of the permanent magnet translated through the ferrofluid to walls of the container, which walls act as resonators creating sound waves in surrounding medium.

12 Claims, 4 Drawing Sheets

AUDIO SPEAKER UTILIZING AN UNANCHORED MAGNET FOR PRIMARY FORCE GENERATION

CROSS-REFERENCE TO RELATED APPLICATIONS

Figure 1A:
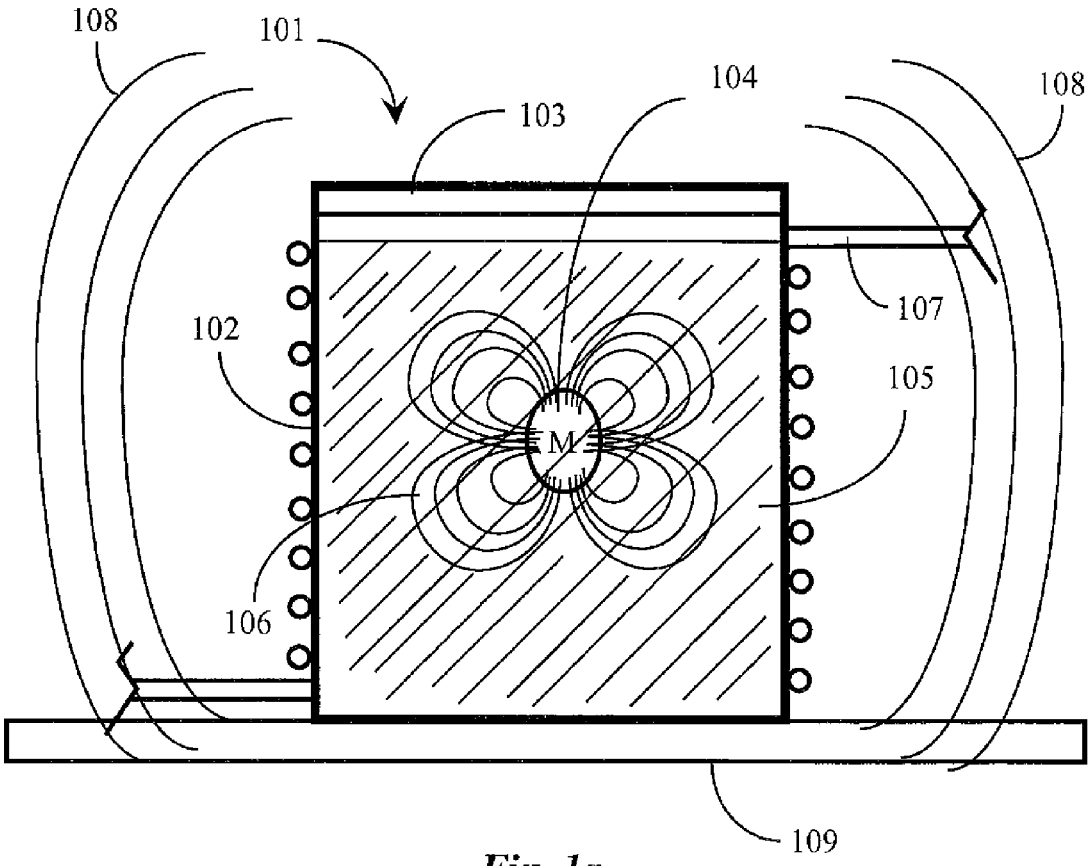

The instant application claims priority to a copending patent application Ser. No. 11/282,335, filed on Nov. 18, 2005, and provisional patent application 60/637,733, filed Dec. 20, 2004. Disclosure of the prior applications are incorporated herein in their entirety by reference.

BACKGROUND OF THE INVENTION

1. Field of the Invention

This invention is in the area of audio output devices, typically termed speakers in the art, which accept electrical signals and convert the signals to audible sound, such as music, speech and the like.

2. Discussion of the State of the Art

Speakers are typically fabric cones attached to metal structure which is driven by managed magnetic field variation to vibrate and cause the attached fabric to vibrate commensurately, which creates pressure anomalies in the air around us, which our ears intercept and interpret as sound. The focus, power and other aspects of such speakers are limited. What is needed is a new and different way of making speakers that allows more freedom in directional output, more power application, and more variation in size and shape than possible with existing technology.

SUMMARY OF THE INVENTION

In an embodiment of the present invention a speaker apparatus is provided, comprising a container holding a volume of ferrofluid, a permanent magnet suspended in the ferrofluid and a magnetic excitation apparatus proximate the container. Operation of the excitation apparatus causes movement of the permanent magnet, translated through the ferrofluid to walls of the container, which walls act as resonators creating sound waves in surrounding medium.

In one embodiment the excitation apparatus is a coil of electrical conductor wound around the container. Also in one embodiment the container has a removable portion for adding the ferrofluid and permanent magnet. Further in an alternative embodiment the excitation apparatus comprises a plurality of coils.

In some embodiments the container is made of one of plastic, wood or metal. The coil may be wound directly on the container, or in some cases encapsulated in walls of the container. Also in some embodiment the coil is separate from the container, not physically connected to the container.

In some embodiments the container is cylindrical in shape. In other embodiments the container may be substantially spherical in shape. In still other embodiment the container may have an egg shape. Other shapes may be used for aesthetic or functional purposes and it is known to the inventor that any shape can be used in the invention. The container may be either transparent or semi-transparent. In this case there may be a light source inside the container coordinated in light output with the signal from the excitation apparatus. In still other embodiments there may be one or more secondary resonators to the container acting as a first resonator.

In another aspect of the invention a method for audio production is provided, comprising the steps of (a) placing a ferrofluid and a permanent magnet in a container; (b) placing an excitation apparatus in proximity of the permanent magnet; and (c) driving the excitation apparatus to cause movement of the permanent magnet translated through the ferrofluid to walls of the container, which walls act as resonators creating sound waves in surrounding medium.

In some embodiments of the method the container has a removable portion for adding the ferrofluid and permanent magnet. Also in some embodiments the excitation apparatus comprises a plurality of coils. The container may be made of one of plastic, wood or metal.

In some cases the coil may be wound directly on the container, while in others the coil may be encapsulated in walls of the container. In still others the coil may be separate from the container, not physically connected to the container.

In some embodiments the container may be cylindrical in shape. In other embodiments the container may be substantially spherical in shape. In still other embodiments the container may have an egg shape. Other shapes may be used for aesthetic or functional purposes. In some cases the container may be either transparent or semi-transparent, and there may be a light source inside the container coordinated in light output with the signal from the excitation apparatus. Also in some embodiments there may be one or more secondary resonators coupled to the container acting as a first resonator.

BRIEF DESCRIPTION OF THE DRAWING FIGURES

FIG. 1*a* is a sectioned elevation view of a speaker in an embodiment of the present invention.

Figure 1B:
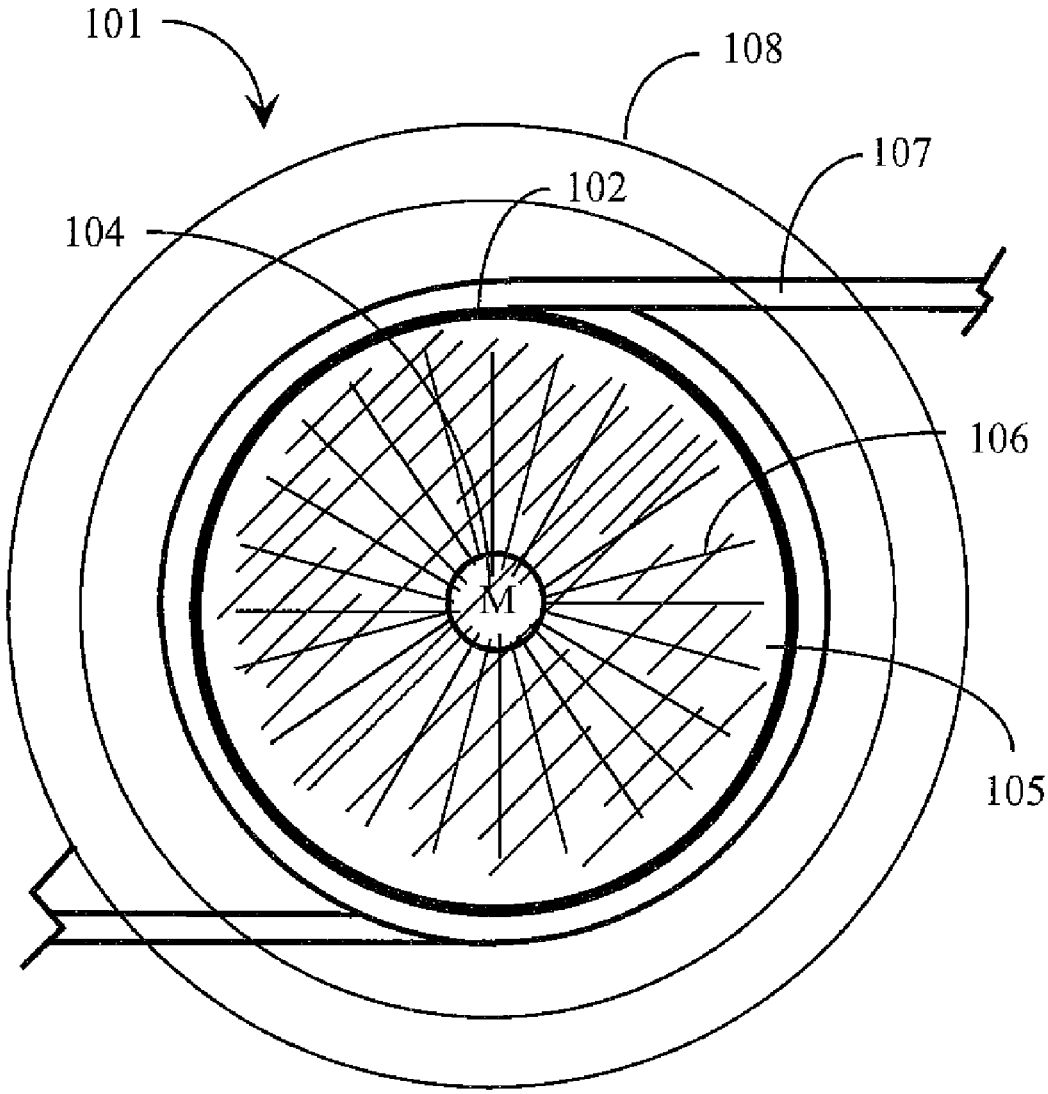

FIG. 1*b* is a plan view of the speaker of FIG. 1*a*.

Figure 2A:
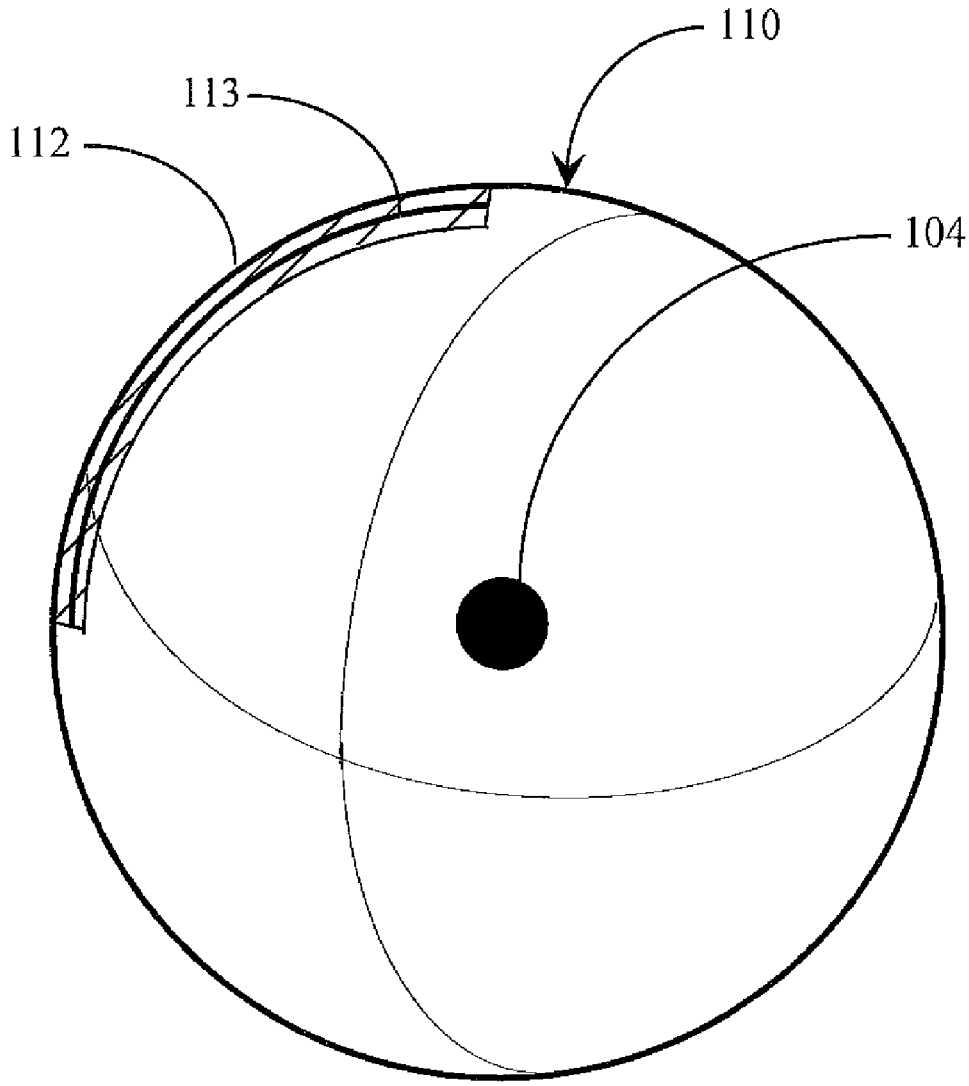

FIG. 2*a* is an illustration of a speaker in a spherical shape with a coil embedded in a wall of the speaker, in an embodiment of the invention.

Figure 2B:
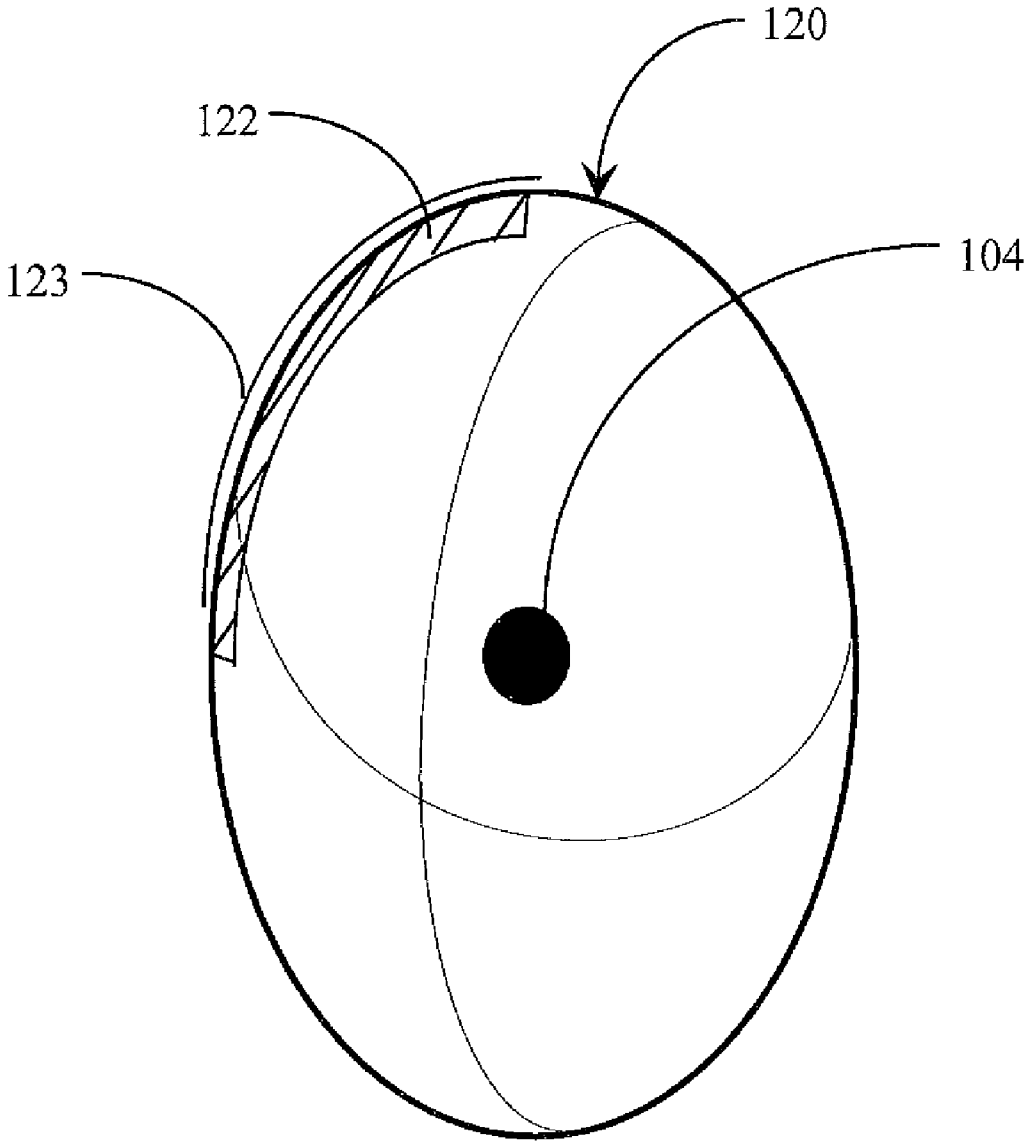

FIG. 2*b* is an illustration of a speaker in an egg shape with a coil outside the wall of the speaker, in an embodiment of the invention.

DETAILED DESCRIPTION

FIGS. 1*a* and 1*b* show an elevation view and a plan view respectively of a speaker 101 in an embodiment of the present invention. Speaker 101 in this embodiment comprises an outer container 102. In this example the container may be a plastic container, like a pill bottle. The container in this example has a lid 103 which may be removed to fill the container at least partially with a ferrofluid 105. A ferrofluid is a stable colloidal suspension of sub-domain magnetic particles in a liquid or semi-liquid carrier. The particles, which in one embodiment have an average size of about 100 Å (10 nm), may be coated with a stabilizing dispersing agent (surface-acting, or surfactant) which prevents particle agglomeration even when a strong magnetic field gradient is applied to the ferrofluid. In the absence of a magnetic field, the magnetic moments of the particles are randomly distributed and the fluid typically has no net magnetization.

An unanchored permanent magnet 104, labeled M is suspended in the ferrofluid as a primary force generator. The permanent magnet in this embodiment is freely suspended inside container 102 that contains the ferrofluid 105 that provides dampening and force transmission. Lines of force 106 related to the permanent magnet cause the permanent magnet to be suspended in the ferrofluid.

A coil 107, in this case of electrically conductive metal, for transmitting an audio signal from a source, is wound about container 102 in this example. The coil acts as an excitation apparatus for the permanent magnet in proximity of the container. The coil 113 may, in some embodiments be encapsulated in the container walls 112, as shown in FIG. 2*a*. Coil 123 may be adhered to the container in different ways, or may be situated separately from the container, as shown in FIG. 2*b*, such that the coil is not subject to forces acting on the container walls. In some embodiments there may be multiple coils arranged in different geometry for various purposes. One might desire, for example to have bass audio transmitted by one coil, and other audio by another. Audio directional effects may be varied by different coils in different geometry as well.

In this example the coil is connected to an output of an audio amplifier, not shown, such as an amplifier that drives a conventional speaker. The signal on the coil generates a varying magnetic field in the environment of the permanent magnet, which is immersed and suspended in the ferrofluid. The varying field from the coil vibrates the magnet, which movement transmits movement by force across the essentially incompressible ferrofluid to walls of the container. The container walls act as a resonator in place of the paper or metal cone of conventionally designed speakers, causing pressure perturbations in the surrounding air, indicated in FIGS. 1*a* and 1*b* by pressure lines 108.

It is not required that the container, such as container 102 in this example, be of the shape of a bottle, as shown. FIGS. 2*a* and 2*b* show container 110 and 120 may be spherical, or egg-shaped, or may have some other shape depending on aesthetic or acoustical considerations. The container may also be made of any one or a combination of different materials, including, but not limited to plastic, wood, metal and plastic. It is not always required that the material of the container be rigid. In some cases the walls may be somewhat flexible.

In some embodiments the container may be mounted to other structures, for example a tabletop 109, as seen in FIG. 1*a*, which than also act as a resonator. One advantage of such a design is that there are no fragile moving parts, such as a paper cone, that may tear when too high an input signal is provided, or that may degrade substantially over time. In another embodiment the container may be attached to a conventional cone of a conventional speaker. In another embodiment the container is cone made of a high strength material.

Magnet strength may be chosen in coordination with the viscosity of the ferrofluid, particle size in ferrofluid, saturation magnetization, and volume of ferrofluid used, as well as in concert with other considerations. Due to various properties of ferrofluids in reaction to the field of the permanent magnet, the fluid gathers into a substantially spherical shape around the core magnet that is placed inside the container. The number of coils should be sufficient to generate a substantial force on the magnet/fluid system and a standard impedance value for audio output systems may be preferred. The leads of the coil should be attached to an appropriate audio source for the rest of the construction parameters chosen.

To enhance the sound quality and ensure that the primary drive magnet stays floating or suspended in the ferrofluid, magnets of significantly lesser strength may be placed in opposite polarity to the primary magnet at the ends of the drive cylinder.

In one prototype design a fragment of a permanent magnet from a computer hard drive is used, and suspended in a volume of approx. 25 ml of ferrofluid in a plastic prescription pill bottle. The ferrofluid used in this particular prototype has the following properties:

Ferrotec EFH1

Medium—Light Mineral Oil

Saturation Magnetization—400 Gauss

Density—1.21 gm/ml

Viscosity—6 centipoise (cp) @27° C.

Surface Tension—29 dynes/cm

This volume of ferrofluid is placed in a cylinder approx 0.75" in diameter and 1.5" in height. Fifty coils of 20 ga. magnetic wrap wire are used for electromagnetic excitation. For additional amplification, the container is placed inside a tin can approx 3.5" in diameter and 1" in height. The core apparatus is held in place by a light foam insulator that fills the remainder of the tin can resonator.

This prototype is sufficient to listen to television audio and music at reasonable volume levels and with negligible distortion from a distance of up to about thirty feet. In other embodiments the number of coils may be significantly increased and the gauge of wire used significantly decreased. The number of coils and gauge of wire used in this prototype were chosen to allow manual assembly and manipulation. A magnet of known strength and shape might be chosen to best attenuate the signal of the coils. The properties and volume of ferrofluid might also need to change based on the properties of the coil and magnet used. The container used in this prototype is likely not ideal, and was a simple medicine bottle. It was chosen for its ability to prevent fluid from leaking and as a convenient and efficient shape on which to wind the magnetic coils. In practice, a cylinder might still be a favorable shape for a container, due to properties of magnetic coils. However the shape and size may change to best suit any application.

Novel and advantageous applications for such unique speakers exist in a broad variety. In the quest for ever more powerful speakers, the audio industry must develop newer, stronger metals and polymers that can cope with ever-increasing power requirements. In the design of this invention in various embodiments, one of the few known strict requirement is that the container must not leak fluid. Other than that it can be constructed out of essentially any durable material that is impervious to the destructive environment most speakers face. As was demonstrated by the prototype described above, even with arbitrarily chosen components a simple medicine bottle was sufficient to produce a clear audible sound from a reasonable listening distance. The speaker is also inherently weatherproof by not having any material external to the device which could be damaged by the environment however it is possible for the fluid to freeze or to boil if the thermal limits of the medium are exceeded.

It will be apparent to the skilled artisan that there are many variations that might be made in embodiments of the present invention without departing from the spirit and scope of the invention, and there are a broad variety of applications for the invention, in essence creating new inventions in many other areas. For example, there are many sorts of ferrofluids that might be used. Some are opaque, and some are transparent. Mixtures of the two may be used to provide unusual appearance through a transparent or semi-transparent container. Many shapes and materials may be used for containers. Many shapes and materials may be used for connected resonators. It is possible to make transparent coils as well to enhance the visual effects that may be obtained in concert with the audio effects. In some cases containers may be completely filled with ferrofluid, and even pressurized to provide special effects.

In application speakers in novel shapes and sizes may be provided. One may, for example, make a life-size model of a person, with the head filled or partially filled with ferrofluid with a suspended magnet and appropriate coils, so the pseudo person may be made to speak without use of conventional speakers. There are many such novel applications and more will emerge as the technology is developed. In another embodiment the container of such a speaker may be transparent, so the magnet within and the ferrofluid may be visible through the walls of the container. The ferrofluid may have color. In some cases the container may be a colored plastic, and there may be one or more light sources inside the container coordinated in function with the signals provided by the excitation apparatus.

What is claimed is:

1. A speaker apparatus comprising:

a container holding a volume of ferrofluid;

a permanent magnet suspended in the ferrofluid; and a magnetic excitation apparatus proximate the container;

wherein imposing on the excitation apparatus a signal of varying amplitude and frequency causes vibration of the permanent magnet within the ferrofluid, and the vibration is translated by pressure through the ferrofluid to walls of the container, which walls act as resonators creating sound waves in surrounding air.

2. The apparatus of claim 1 wherein the excitation apparatus is at least one coil of electrical conductor wound around the container.

3. The apparatus of claim 2 wherein the at least one coil is encapsulated in a wall of the container.

4. The apparatus of claim 2 wherein the at least one coil is separate from the container, not physically connected to the container.

5. The apparatus of claim 1 wherein the container is either transparent or semitransparent.

6. The apparatus of claim 5 wherein a light source inside the container is coordinated in light output with the signal from the excitation apparatus.

7. A method for converting signals to audible sound, comprising the steps of:

filling a container with a volume of ferrofluid;

suspending a permanent magnet in the ferrofluid; and driving a magnetic excitation apparatus proximate the container with signals of varying amplitude and frequency, the signals causing the magnet to vibrate, generating pressure waves through the ferrofluid to a wall of the container, which acts as a resonator, producing audible sound in the surrounding air.

8. The method of claim 7 wherein the excitation apparatus is at least one coil of electrical conductor wound around the container.

9. The method of claim 8 wherein the at least one coil is encapsulated in a wall of the container.

10. The method of claim 8 wherein the at least one coil is separate from the container, not physically connected to the container.

11. The method of claim 7 wherein the container is either transparent or semitransparent.

12. The apparatus of claim 11 wherein a light source inside the container is coordinated in light output with the signal from the excitation apparatus.

* * * * *